United States Patent [19]

Krieg

[11] 4,078,689

[45] Mar. 14, 1978

[54] SCREW-ON JAR TOP WITH UPSTANDING EARS

[75] Inventor: Adrian H. Krieg, Yorktown Heights, N.Y.

[73] Assignee: Widder Corporation, Naugatuck, Conn.

[21] Appl. No.: 791,695

[22] Filed: Apr. 28, 1977

[51] Int. Cl.[2] ..... B65D 17/16
[52] U.S. Cl. ..... 215/302
[58] Field of Search ..... 215/302

[56] References Cited

U.S. PATENT DOCUMENTS

| | | | |
|---|---|---|---|
| 2,067,117 | 1/1937 | Carhart | 215/302 |
| 2,094,567 | 9/1937 | Barnby | 215/302 |

*Primary Examiner*—George T. Hall
*Attorney, Agent, or Firm*—Bierman & Bierman

[57] ABSTRACT

A screw-on jar top having opposing ears formed from jar top side material and protruding above the edge of the top is disclosed, while the seal between the top and the jar is maintained. The ears are shaped to receive a leverage-applying member to permit easier opening of the top when it is tightly screwed on, and to permit stacking of jars without interference from the ears.

3 Claims, 3 Drawing Figures

SCREW-ON JAR TOP WITH UPSTANDING EARS

BACKGROUND OF THE INVENTION

It has been observed that jars such as those normally found in stores by consumers, very often have screw-on tops that are difficult for the ordinary person to unscrew. Sometimes the difficulty arises from the fact that the interior of the jar has been partially evacuated to preserve the perishable goods inside thereby causing atmospheric pressure to increase the difficulty of opening the jar. Even with unevacuated jars, the top is often screwed on so tightly that the ordinary person has great difficulty in opening the jar top. The purpose of this invention is to provide a jar top that will be easy for the consumer to open, inexpensive to manufacture, and yet permit jars to be easily stacked and packaged for shipment or display.

GENERAL DESCRIPTION OF THE INVENTION

Applicant's invention is a jar top comprising a circular top portion with a circumferential, downwardly extending side portion and threads formed on the interior of the side portion for engaging a set of complimentary threads on the jar. The complimentary sets of threads cooperate to permit the jar top to be screwed on and off in a manner that is well-known and conventional in the art. Two opposing ears are formed from the side material so that they protrude above the circumference of the jar top. These ears may be shaped to engage any leverage-applying member such as a knife by the person seeking to unscrew the jar top.

It will be appreciated that although the opposing ears are formed from the side material, according to this invention, enough side material remains to allow the jar top to effectively grip and seal with the lip of a jar. The jar top may be manufactured by any conventional method well known in the art such as being stamped out of one solid piece in one operation with a progressive dye.

The foregoing and other objects and advantages of the invention, as well as the basic characteristics thereof, including equivalents and substitutions therefor, are better understood by givning consideration to the detailed description to the embodiment of the invention.

In the accompanying drawings, in which the like reference characters indicate like parts, FIG. 1 is a plan view showing the embodiment of the invention;

Figure 2:
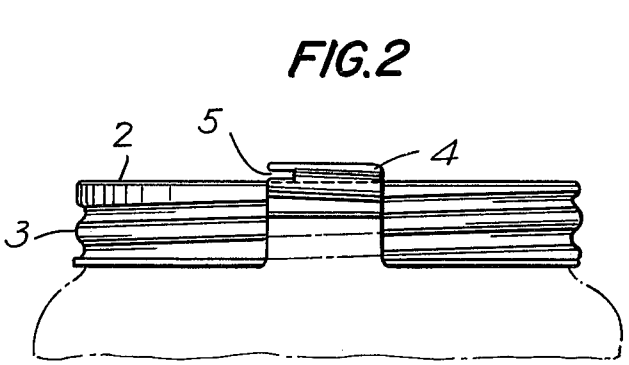
FIG. 2 is a side view showing a full view of one of the ears.
Figure 3:
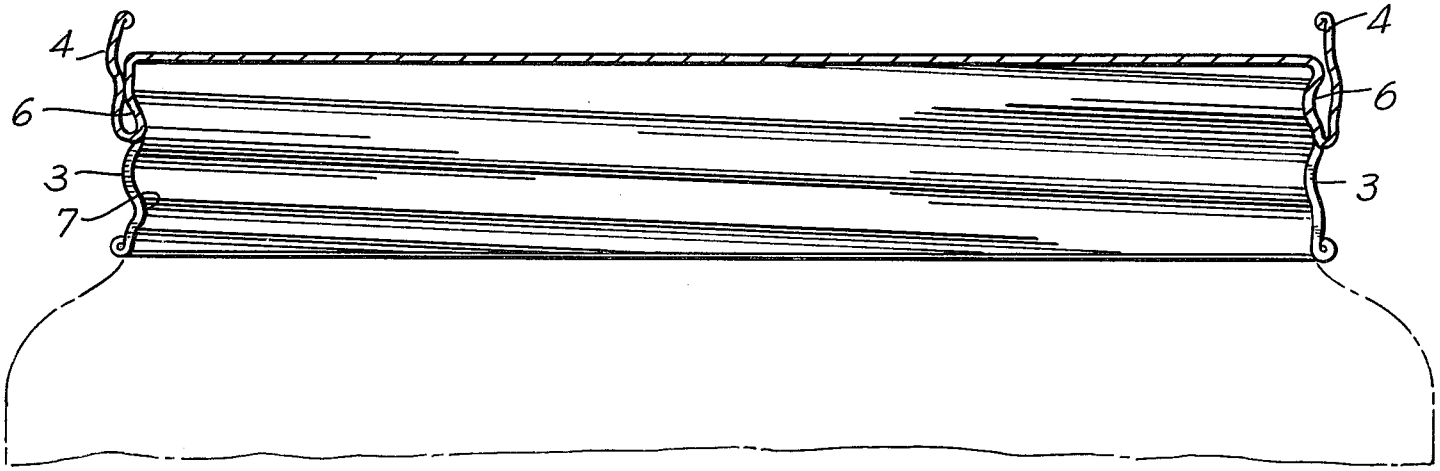
FIG. 3 is an enlarged sectional side view showing both ears.
Figure 1:
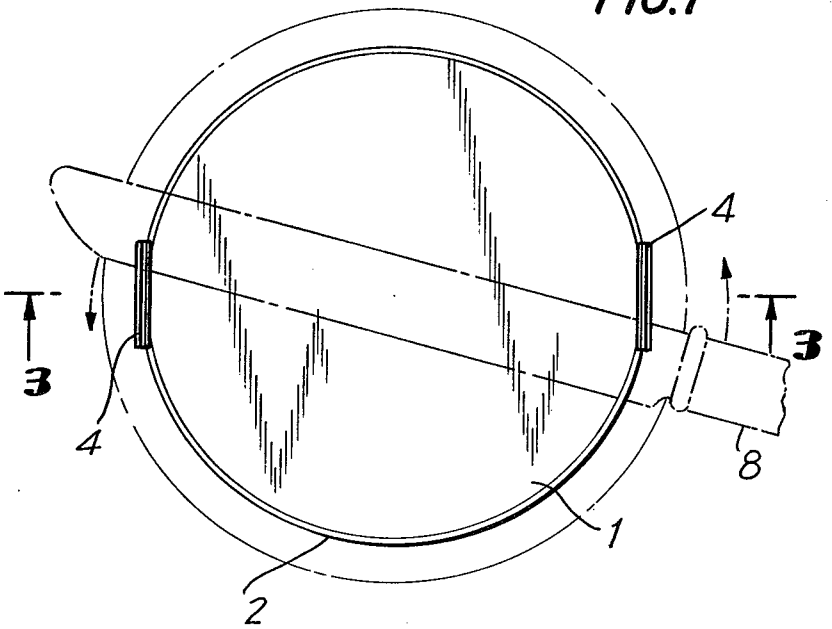

Referring to FIGS. 1–3, the jar top comprises a top 1 having an edge 2 and a downwardly extending circumferential side 3. Threads 7 are formed on the inner surface of the side 3 for engaging and cooperating with the threads of a jar. The ears 4 are cut from the side 3 and protrude above the adjacent to edge 2. In the preferred embodiment, slits are formed in ears 4 for receiving a thin leveraging member such as a knife 8. It will be appreciated that these slits will be formed in both ears 4 so that both slits can simultaneously engage the leveraging member.

Furthermore, if desired, the slits 5 can be omitted, in which event the leveraging member will merely bear against the upstanding edges of the ears 4.

In order that a proper seal is maintained between the jar top and the jar, the depth of the cut before the ears 5 are upended must be such that a sufficient amount of material 6 remains to threadably engage the threads in the jar.

What we claim is:

1. A jar top comprising a circular top having a downwardly extending circumferential side and threads formed on the inner surface of said side for engaging a set of complimentary threads on said jar; said sets of threads cooperating to permit said top to be screwed on and off and form a seal with said jar, and said top further comprising at least two upwardly extending opposing ears formed from a portion of said side and protruding above the circumference of said jar top for cooperating with a leverage-applying member.

2. The top according to claim 1 in which the said ears extend downwardly along said side such a distance as to leave sufficient material on the inner surface of the said portion of the side to threadably engage the jar.

3. The jar top according to claim 2 in which said protruding ears are each provided with a slit adapted to receive a leverage-applying member.

* * * * *